US005256170A

United States Patent [19]

Harmer et al.

[11] Patent Number: 5,256,170

[45] Date of Patent: Oct. 26, 1993

[54] COATED ABRASIVE ARTICLE AND METHOD OF MAKING SAME

[75] Inventors: Walter L. Harmer, Arden Hills; Robert J. DeVoe, Oakdale; Eric G. Larson, Lake Elmo, all of Minn.; Don H. Kincaid, Hudson, Wis.; Peggy S. Willett, Stillwater; Jerry W. Williams, Cottage Grove, both of Minn.

[73] Assignee: Minnesota Mining and Manufacturing Company, St. Paul, Minn.

[21] Appl. No.: 823,762

[22] Filed: Jan. 22, 1992

[51] Int. Cl.[5] ..... B24D 3/00

[52] U.S. Cl. ..... 51/293; 51/295; 51/298; 428/323; 428/328

[58] Field of Search ..... 51/293, 295, 298, 309; 428/323, 328

[56] References Cited

U.S. PATENT DOCUMENTS

| | | | |
|---|---|---|---|
| 2,015,658 | 10/1935 | Bezzenberger | 51/278 |
| 2,053,360 | 9/1936 | Benner et al. | 91/70 |
| 3,018,262 | 1/1962 | Schroeder | 260/29.2 |
| 3,177,099 | 4/1965 | Dirk et al. | 136/100 |
| 3,401,190 | 9/1968 | Schmitt et al. | 260/453 |
| 3,654,106 | 4/1972 | Wagner et al. | 204/159.23 |
| 3,887,450 | 6/1975 | Gilano et al. | 204/159.15 |
| 3,895,949 | 7/1975 | Akamatsu et al. | 96/86 |
| 4,047,903 | 9/1977 | Hesse et al. | 51/298 |
| 4,304,705 | 12/1981 | Heilmann et al. | 260/30.4 |
| 4,588,419 | 5/1986 | Caul et al. | 51/295 |
| 4,642,126 | 2/1987 | Zador et al. | 51/295 |
| 4,652,274 | 3/1987 | Boettcher et al. | 51/298 |
| 4,735,632 | 4/1988 | Oxman et al. | 51/295 |
| 4,740,577 | 4/1988 | DeVoe et al. | 51/298 |
| 4,751,138 | 6/1988 | Tumey et al. | 428/323 |
| 4,927,431 | 5/1990 | Buchanan et al. | 51/298 |
| 4,985,340 | 1/1991 | Palazzotto et al. | 430/270 |
| 4,997,717 | 3/1991 | Rembold et al. | 478/413 |
| 5,059,701 | 10/1991 | Keipert | 556/13 |

OTHER PUBLICATIONS

Lee and Neville, "Handbook of Epoxy Resins," pages (1967).

Wicks, "Progress in Organic Coatings," vol. 9, pp. 3–28 (1981).

Karabatsos et al., 30 *J. Org. Chem.* 689 (1965).

Cox, Jr., 80 *J. Am. Chem. Soc'y* 5441 (1958).

Goldwhite, 79 *J. Am. Chem. Soc'y* 2409 (1957).

Cox, Jr, 54 *J. Org. Chem.* 2600 (1969).

Hawley's Condensed Chemical Dictionary p. 858 (Sax and Lewis, 11th ed. 1987).

Houwink and Salomon, *Adhesion and Adhesives* (Elsevior Publishing Co. 1967).

*Primary Examiner*—Mark L. Bell

*Assistant Examiner*—Willie J. Thompson

*Attorney, Agent, or Firm*—Gary L. Griswold; Walter N. Kirn; Carolyn V. Peters

[57] ABSTRACT

A method for preparing a coated abrasive article wherein the a plurality of abrasive grains are applied to a make coat such that the abrasive grains are substantially a mono-layer. The make coat precursor is a pressure-sensitive adhesive-like or pressure-sensitive adhesive. The make coat precursor is partially cured to approximate a pressure-sensitive adhesive-like layer or when fully cured is a pressure-sensitive adhesive. The make coat precursor has sufficient "tack" to hold the abrasive grains during the application and curing of the size coat, resulting in a substantially monolayer of abrasive grains.

14 Claims, 1 Drawing Sheet

COATED ABRASIVE ARTICLE AND METHOD OF MAKING SAME

BACKGROUND OF THE INVENTION

1. Field of the Invention

This invention relates to a coated abrasive article and a method of making the coated abrasive article, and in particular to a method wherein the make coat precursor is at least partially cured before the abrasive grains are applied.

2. Description of the Related Art

Coated abrasives generally comprise a flexible backing upon which a binder holds and supports a coating of abrasive grains. The coated abrasive typically employs a "make" coat precursor of resinous binder material. The make coat secures the abrasive grains to the backing. A "size" coat precursor of resinous binder material is applied over the make coat and abrasive grains. The size coat firmly bonds the abrasive grains to the backing. Additionally, the abrasive grains are generally oriented with their longest dimension perpendicular to the backing to provide an optimum cut rate.

In a typical manufacturing process for making coated abrasives, the make coat precursor is first applied to the backing. This is followed by electrostatic projection of the abrasive grains into the make coat precursor. The make coat precursor is then partially cured in order to set the abrasive grains. Next, the size coat precursor is applied over the abrasive grains. Finally, the make coat precursor and size coat precursor are fully cured.

One of the major problems associated with this process, is the tendency to apply multiple layers of abrasive grains during the electrostatic coating. This is particularly true in the "fine" grades, that is, where the average particle size of the abrasive grain is less than about 150 micrometers, and usually less than about 100 micrometers. In some instances there may be up to seven layers of abrasive grains applied. This multiple layer becomes increasingly a problem as the abrasive grain particle size is decreased. Reducing the coating weight of the abrasive grain tends to result in a blotchy, non-uniform type coating of multiple layers.

There are a number of disadvantages associated with the multiple layers of abrasive grains. The abrasive grains tend not to be ideally oriented and the abrasive grains tend to lay on top of one another. This results in reduced abrading performance. The multiple layers of abrasive grains can in some cases, reduce the flexibility of the product. Furthermore, the multiple layers of abrasive grains decrease cost efficiency of the coated abrasive due to the extra layers of abrasive grains.

U.S. Pat. No. 2,015,658 (Bezzengerger) describes a method to avoid multiple layer phenomena when forming abrasive articles. The abrasive grain is applied to the make coat precursor by means of a metered roll.

U.S. Pat. No. 2,053,360 (Benner et al.) describes a method of making a coated abrasive wherein the abrasive grains are sprinkled onto a nontacky film of a plasticizable binder. The film is then plasticized such that the binder wets the surface of the abrasive grain.

U.S. Pat. No. 4,047,903 (Hesse et al.) describes a radiation curable binder comprising a resin prepared by at least a partial reaction of (a) epoxy monomers having at least 2 epoxy groups, for example, from diphenylolpropane and epichlorohydrin, with (b) unsaturated monocarboxylic acids, and (c) optionally, polycarboxylic acid anhydride.

U.S. Pat. No. 4,588,419 (Caul et al.) describes an adhesive for coated abrasives comprising a mixture of (a) an electron beam radiation curable resin system comprising an oligomer selected from the group consisting of urethane acrylates and epoxy acrylates, a filler and a diluent, and (b) a thermally curable resin selected from the group consisting of phenolic resins, melamine resins, amino resins, alkyd resins, and furan resins.

U.S. Pat. No. 4,751,138 (Tumey et al.) describes a coated abrasive in which either the make coat or the size coat comprises an ethylenically unsaturated compound, an epoxy monomer and a photoinitiator.

U.S. Pat. No. 4,927,431 (Buchanan et al.) describes an adhesive for coated abrasives comprising a mixture of (a) a radiation curable monomer selected from the group consisting of isocyanurate derivatives having at least one terminal or pendant acrylate group, isocyanate derivatives having at least one terminal or pendant acrylate group, and multifunctional acrylates having on average at least three pendant acrylate groups, and (b) a thermally curable resin selected from the group consisting of phenolic resins, epoxy monomers, urea-formaldehyde resins, melamine-formaldehyde resins, and polyamide resins.

U.S. Pat. No. 4,985,340 (Palazzotto et al.) describes a polymeric precursor that can be employed as a binder for abrasive articles. The polymeric precursor is selected from the group consisting of (1) at least one ethylenically unsaturated monomer, optionally, in combination with an epoxy monomer or polyurethane precursor, (2) at least one epoxy monomer, or (3) polyurethane precursors, and a curing agent comprising an organometallic salt and an onium salt.

U.S. Pat. No. 4,997,717 (Rembold) describes a process for preparing a coated abrasive by applying a binder layer to a support, briefly irradiating the binder layer with actinic light, and then applying abrasive grain to the still tacky layer before or after irradiation, and subsequent or simultaneous heat curing.

SUMMARY OF THE INVENTION

Briefly, in one aspect of the present invention a coated abrasive article is provided comprising (1) a backing, (2) a make coat layer, wherein the make coat layer comprises (a) an ethylenically unsaturated monomer, (b) a cationically polymerizable monomer or a polyurethane precursor, and (c) a curing agent comprising (i) at least one organometallic complex salt, (ii) optionally, at least one thermally decomposable ester reaction product of a tertiary alkyl alcohol and an acid that forms a chelation complex with the metal ion of the organometallic complex salt, and (iii) optionally, at least one free radical initiator, (3) a plurality of abrasive grains and (4) a size coat layer.

In another aspect of the present invention, a first method is provided for making a coated abrasive article comprising:

(1) applying a make coat precursor to a backing, wherein the make coat precursor comprises:
   (a) at least one ethylenically unsaturated monomer, and
   (b) at least one of a cationically polymerizable monomer or a polyurethane precursor, and
   (c) a catalytically-effective amount of a curing agent comprising:

(i) at least one cationically polymerizable monomer or polyurethane precursor initiator, (ii) optionally, at least one thermally decomposable ester reaction product of a tertiary alkyl alcohol and an acid that forms a chelation complex with the metal ion of the organometallic complex salt, provided that component (b) is a cationically polymerizable monomer, and (iii) optionally, at least one free radical initiator;

(2) exposing the make coat precursor to an energy source to activate the organometallic complex salt;

(3) partially polymerizing, either sequentially or simultaneously, the cationically polymerizable monomer or the polyurethane precursor; the ethylenically unsaturated monomer; or both;

(4) applying a plurality of abrasive grains into the make coat precursor;

(5) applying a size coat precursor;

(6) fully curing the make coat precursor; and (7) fully curing the size coat precursor.

When practicing the first method, it is preferable that steps 1 through 4 be accomplished in the order as written. Partial polymerization of (a) the cationically polymerizable monomer or the polyurethane precursor, or (b) the ethylenically unsaturated monomer, or both (a) and (b), results in a solid tacky, pressure-sensitive adhesive-like layer. Advantageously, the partially polymerized make coat does not flow and wet-up the sides of the abrasive grains and permits a "smooth," evenly-coated, substantially mono-layer of abrasive grains. It is an another advantage of the present invention that steps 5 and 6 may be accomplished in any order, and that the order of steps 5 and 6 as written is merely one of a number of routes that may be utilized in practicing the present invention. When the ethylenically unsaturated monomer is initiated by the application of electron beam irradiation, a free radical initiator is not required. In other instances, the ethylenically unsaturated monomer is initiated by adding a catalytically-effective amount of at least one free radical initiator.

In yet another aspect of the present invention, a second method is provided for making a coated abrasive article comprising:

(1) applying a make coat precursor to a backing, wherein the make coat precursor comprises a polymerizable pressure-sensitive adhesive precursor;

(2) fully curing the make coat precursor to a pressure-sensitive adhesive;

(3) applying a plurality of abrasive grains into the cured make coat;

(4) applying a size coat precursor; and (5) fully curing the size coat precursor.

A preferred embodiment of the second method for making a coated abrasive article comprises:

(1) applying a make coat precursor to a backing, wherein the make coat precursor comprises:

(a) at least one ethylenically unsaturated monomer, and (b) at least one of a cationically polymerizable monomer or a polyurethane precursor, and (c) a catalytically-effective amount of a curing agent comprising:

(i) at least one cationically polymerizable monomer or polyurethane precursor initiator, (ii) optionally, at least one thermally decomposable ester reaction product of a tertiary alkyl alcohol and an acid that forms a chelation complex with the metal ion of the organometallic complex salt, provided that component (b) is a cationically polymerizable monomer, and (iii) optionally, at least one free radical initiator;

(2) exposing the make coat precursor to an energy source to activate either sequentially or simultaneously, the cationically polymerizable monomer or the polyurethane precursor; the ethylenically unsaturated monomer; or both;

(3) fully curing the make coat precursor;

(4) applying a plurality of abrasive grains into the make coat precursor;

(5) applying a size coat precursor; and (6) fully curing the size coat precursor.

Advantageously, when practicing the second method, the make coat precursor, when fully cured is a tacky, adhesive layer, such as a pressure sensitive adhesive. Advantageously, the polymerized make coat does not flow and wet-up the sides of the abrasive grains and permits a "smooth," evenly-coated, substantially mono-layer of abrasive grains. When the ethylenically unsaturated monomer is initiated by the application of electron beam irradiation, a free radical initiator is not required. In other instances, the ethylenically unsaturated monomer is initiated by adding a catalytically-effective amount of at least one free radical initiator.

Advantageously, the ethylenically unsaturated monomer polymerization can be initiated by a free radical source, such as by electron beam radiation or with a catalytically-effective amount of a curing agent or initiator. If a curing agent or initiator is employed, the free radical source can be generated by exposing the curing agent or initiator to either heat or a radiation energy source. Examples of typical radiation energy sources include electron beam, ultraviolet light and visible light.

During the manufacture of the abrasive article, the make coat precursor and the size coat precursor are applied typically in a liquid or semi-liquid state since the resin is in an uncured or unpolymerized state. The size coat precursor can be any glutinous or resinous adhesive. Examples of such resinous adhesives include: phenolic resins, acrylate resins, aminoplast resins, exposy monomers, urethane resins, polyester resins, urea-formaldehyde resins and combinations thereof. In general, for a fully cured make coat or size coat, 90% or more of the potential reactive groups on the monomer or precursor have been reacted. The resin in both the make coat precursor and the size coat precursor is fully cured or polymerized to form the make coat and the size coat of the coated abrasive.

Additionally, the make coat precursor and/or the size coat precursor can contain additives that are commonly used in the abrasive industry. These additives include fillers, grinding aids, colorants, coupling agents, surfactants, lubricants, plasticizers, and mixtures thereof.

The advantages of the invention are the reduced tendency to form multiple layers of abrasive grains and the improved performance associated with the coated abrasive of this invention.

Advantageously, polymerization, at least partially of the make coat precursor, is initiated prior to application of abrasive grains and minimizes the amount of abrasive grain coated onto the backing. While not being bound by theory, it is believed that this phenomena is achieved by one of two means. The first pertains to the surface roughness of the coated abrasive backing. Most coated abrasive backings are inherently rough, that is, having a plurality of peaks and valleys. This roughness results in an increased surface area. This in turn allows more abrasive grain to be coated than would be the case with a totally smooth substrate while simultaneously reducing the number of abrasive grains that are in a functional location.

A second problem occurring associated with the backing roughness is that the make coat precursor is usually applied in such a way that more material is deposited in the valleys than on the peaks. If enough of the make coat precursor is applied to the peaks to firmly anchor a monolayer of abrasive grain, the excess make coat precursor in the valleys results in multiple layers of abrasive grains at these locations. If the polymerization of the make coat precursor is initiated before the abrasive grains are applied, then sufficient make coat precursor can be used to fill up the valleys, thereby decreasing the surface area. This in turn leads to a reduction in the abrasive grain coating weight. Since the make coat precursor is no longer liquid at this point, the increased amount of make coat precursor present in the valleys of the backing does not result in the multiple layers of abrasive grain at these locations as would otherwise be the case.

In this application:

"catalytically-effective amount" means a quantity sufficient to effect polymerization of the curable composition to a polymerized product at least to a degree to cause an increase in the viscosity of the composition;

"cationically polymerizable monomer" means materials that undergo cationic polymerization and include 1,2-, 1,3-, and 1,4- cyclic ethers, vinyl ethers, cyclic formals, and cyclic organosiloxanes;

"cured" and "polymerized" can be used interchangeably;

"epoxy monomer" means monomeric materials, oligomeric materials or polymeric materials which contain an oxirane ring, such that the epoxy monomer is polymerizable by ring opening;

"ethylenically unsaturated monomer" means those monomers that polymerize by a free-radical mechanism;

"fully cured" means the make coat precursor or size coat precursor has been polymerized or substantially converted;

"make coat precursor" means the polymerizable composition applied over the front surface of a backing that secures abrasive grains to the backing;

"organometallic compound" means a chemical substance in which at least one carbon atom of an organic group is bonded to a metal or nonmetal atom (*Hawley's Condensed Chemical Dictionary* 858 (N. Sax & R. Lewis 11th ed. 1987);

"polyisocyanate" means an aliphatic or aromatic isocyanate compound containing 2 or more isocyanate groups; and "polyurethane precursor" means a mixture of one or more monomers of the type including polyisocyanates, and one or more monomers of the type including polyols. Compounds bearing at least two isocyanate-reactive hydrogen atoms may be substituted for diols and polyols; the ratio of isocyanate groups to isocyanate-reactive hydrogen atoms is 1:2 to 2:1;

"polyol" means an aliphatic or aromatic compound containing 2 or more hydroxyl groups;

"pressure sensitive adhesive precursor" means a polymerizable material that when fully cured has the properties of (1) being tacky, (2) exerting a strong holding force, (3) having sufficient cohesiveness and elasticity that it can be removed from smooth surfaces without leaving a visible residue, and (4) requiring no activation by water, solvent or heat to become tacky; and "size coat precursor" means the polymerizable composition applied over the abrasive grains/make coat precursor and further reinforces the abrasive grains.

DETAILED DESCRIPTION OF THE PREFERRED EMBODIMENT(S)

Figure 1:
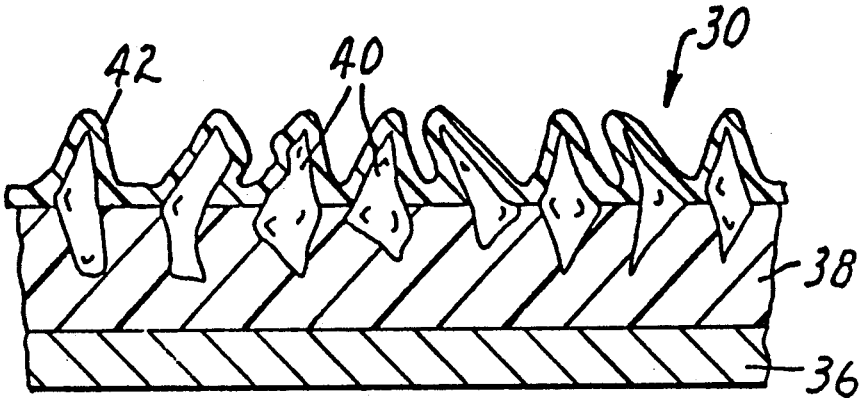
FIG. 1 illustrates in enlarged cross section a segment of a coated abrasive containing a backing.

This invention pertains in particular to the coated abrasive article and to a method of making a coated abrasive article.

Referring to FIG. 1, in a preferred embodiment coated abrasive article 30 is typically cloth- or paper-backed. Overlaying backing 36 is make coat 38 in which is embedded a plurality of abrasive grains 40. Size coat 42 is coated over make coat 38 and the plurality of abrasive grains 40.

In a preferred embodiment of the present invention, a coated abrasive article is provided comprising (1) a backing, (2) a make coat layer, wherein the make coat layer comprises (a) an ethylenically unsaturated monomer, (b) a cationically polymerizable monomer or a polyurethane precursor, and (c) a curing agent comprising (i) at least one organometallic complex salt, (ii) optionally, at least one thermally decomposable ester reaction product of a tertiary alkyl alcohol and an acid that forms a chelation complex with the metal ion of the organometallic complex salt, and (iii) optionally, at least one free radical initiator, (3) plurality of abrasive grains and (4) a size coat layer.

In another aspect of the present invention, a first method is provided for making a coated abrasive article comprising:

(1) applying a make coat precursor to a backing, wherein the make coat precursor comprises:
  (a) at least one ethylenically unsaturated monomer, and
  (b) at least one of a cationically polymerizable monomer or a polyurethane precursor, and
  (c) a catalytically-effective amount of a curing agent comprising:
    (i) at least one cationically polymerizable monomer or polyurethane precursor initiator,
    (ii) optionally, at least one thermally decomposable ester reaction product of a tertiary alkyl alcohol and an acid that forms a chelation complex with the metal ion of the organometallic complex salt, provided component (b) is a cationically polymerizable monomer, and
    (iii) optionally, at least one free radical initiator;
(2) exposing the make coat precursor to an energy source to activate the organometallic complex salt;
(3) partially polymerizing, either sequentially or simultaneously, the cationically polymerizable monomer or the polyurethane precursor; the ethylenically unsaturated monomer; or both;
(4) applying a plurality of abrasive grains into the make coat precursor;
(5) applying a size coat precursor;
(6) fully curing the make coat precursor; and
(7) fully curing the size coat precursor.

When using the first method, it is preferable that steps 1 through 4 are accomplished in the order as written. Partial polymerization of (a) the cationically polymerizable monomer or the polyurethane precursor, or (b) the ethylenically unsaturated monomer, or both (a) and (b), results in a tacky, pressure-sensitive adhesive-like layer. Advantageously, the partially polymerized make coat does not flow and wet-up the sides of the abrasive grains and permits a "smooth," evenly-coated, substantially mono-layer of abrasive grains. It is an another advantage of the present invention that steps 5 and 6 may be accomplished in any order, and that the order of steps 5 and 6 as written is merely one of a number of routes that may be utilized in practicing the present invention. When the ethylenically unsaturated monomer is initiated by the application of electron beam irradiation, a free radical initiator is not required. In other instances, the ethylenically unsaturated monomer is initiated by adding a catalytically-effective amount of at least one free radical initiator.

In yet another aspect of the present invention, a second method is provided for making a coated abrasive article comprising:

(1) applying a make coat precursor to a backing, wherein the make coat precursor comprises a polymerizable pressure-sensitive adhesive precursor;
(2) fully curing the make coat precursor to a pressure-sensitive adhesive;
(3) applying a plurality of abrasive grains into the cured make coat;
(4) applying a size coat precursor; and
(5) fully curing the size coat precursor.

A preferred embodiment of the second method for making a coated abrasive article comprises:

(1) applying a make coat precursor to a backing, wherein the make coat precursor comprises:
  (a) at least one ethylenically unsaturated monomer, and
  (b) at least one of a cationically polymerizable monomer or a polyurethane precursor, and
  (c) a catalytically-effective amount of a curing agent comprising:
    (i) at least one cationically polymerizable monomer or polyurethane precursor initiator,
    (ii) optionally, at least one thermally decomposable ester reaction product of a tertiary alkyl alcohol and an acid that forms a chelation complex with the metal ion of the organometallic complex salt, provided component (b) is a cationically polymerizable monomer, and
    (iii) optionally, at least one free radical initiator;
(2) exposing the make coat precursor to an energy source to activate either sequentially or simultaneously, the cationically polymerizable monomer or the polyurethane precursor; the ethylenically unsaturated monomer; or both;
(3) fully curing the make coat precursor;
(4) applying a plurality of abrasive grains into the make coat precursor;
(5) applying a size coat precursor; and
(6) fully curing the size coat precursor.

Advantageously, when using the second method, the make coat precursor, when fully cured is a tacky, adhesive layer, such as a pressure sensitive adhesive. Advantageously, the polymerized make coat does not flow and wet-up the sides of the abrasive grains and permits a "smooth," evenly-coated, substantially mono-layer of abrasive grains. Preferably, the ethylenically unsaturated monomer is initiated by the application of electron beam irradiation and as such a free radical initiator is not required, although such an initiator may be present. In other instances, the ethylenically unsaturated monomer is initiated by adding a catalytically-effective amount of at least one free radical intiator.

The backing used in the preferred embodiment may be any substrate type material, generally known to those skilled in the art and may include, but is not limited to nonwoven substrates, polymeric film, paper, cloth, vulcanized fibre, metal plates and treated versions and combinations thereof.

The make coat precursor is applied to the front side by any conventional coating technique known to those skilled in the art and may include, but is not limited to roll coating, die coating, spray coating and curtain coating. The preferred coating technique is knife coating.

The make coat precursor comprises (a) an ethylenically unsaturated monomer, (b) a cationically polymerizable monomer or a polyurethane precursor and (c) a catalytically-effective amount of a curing agent (or initiator) for either the cationically polymerizable monomer or the polyurethane precursor, (d) optionally, at least one thermally decomposable ester reaction product of a teritary alkyl alcohol and an acid that forms a chelation complex with the metal ion of the organometallic complex salt, provided component (b) is an epoxy monomer and (e) optionally, at least one free radical initiator.

Ethylenically unsaturated monomers that undergo free radical polymerization include (meth)acrylates, (meth)acrylamides and vinyl compounds. The ethylenically unsaturated monomers can be a monomulti-functional, or a mixture thereof.

Examples of such ethylenically unsaturated monomers include mono-, di-, or polyacrylates and methacrylates, methyl acrylate, methyl methacrylate, ethyl acrylate, isopropyl methacrylate, isooctyl acrylate, acrylic acid, n-hexyl acrylate, stearyl acrylate, allyl acrylate, vinylazlactones as described in U.S. Pat. No. 4,304,705 and such description is incorporated herein by reference, isobornyl acrylate, isobornyl methacrylate, acrylic acid, N-vinyl caprolactam, acrylonitrile, allyl acrylate, glycerol diacrylate, glycerol triacrylate, ethylene glycol diacrylate, diethylene glycol diacrylate, 1,6-hexanediol diacrylate, 2-phenoxyethylacrylate, 1,4-cyclohexanediol diacrylate, 2,2-bis[1-(3-acryloxy-2-hydroxy)]propoxyphenlpropane, tris(hydroxyethyl-)isocyanurate trimethacrylate; the bis-acrylates and bismethacrylates of polyethylene glycols of molecular weight of 200 to 500, ethylene glycol diacrylate, butyl acrylate, tetrahydrofurfuryl acrylate, N-vinyl pyrrolidone, diethyleneglycol diacrylate, triethyleneglycol diacrylate, tetraethyleneglycol diacrylate, 1,4-butanediol diacrylate, triethyleneglycol dimethacrylate, 1,3-propanediol diacrylate, 1,3 propanediol dimethacrylate, trimethylolpropane triacrylate, 1,2,5,-butanetriol trimethacrylate, 4,5-cyclohexanediol diacrylate, pentaerythritol triacrylate, pentaerythritol tetraacrylate, pentaerythritol tetramethacrylate, sorbitol hexacrylate, bis[1-(2-acryloxy)]-p-ethoxyphenyldimethylmethane, bis[1-(3-acryloxy-2-hydroxy)]-p-propoxyphenyl -dimethylmethane, copolymerizable mixtures of acrylated monomers such as those of U.S. Pat. No. 4,652,274 and acrylated oligomers such as those of U.S. Pat. No. 4,642,126; bireactive monomers such as epoxy (meth)acrylates, isocyanato (meth)acrylates, and hydroxy (meth)acrylates, hydroxyethyl (meth)acrylate, hydroxypropyl (meth)acrylate, isocyanatoethyl (meth)acrylate, glycidyl (meth)acrylate, and m-isopropenyl-alpha, alpha-dimethylbenzyl isocyanate, unsaturated amides, such as acrylamide, N,N-dimethyl acrylamide, methylene bis-acrylamide, methylene bis-methacrylamide, 1,6-hexamethylene bisacrylamide, diethylene triamine tris-acrylamide and beta-methacrylamidoethyl methacrylate; and vinyl compounds such as styrene, divinylbenzene, diallyl phthalate, divinyl succinate, divinyl adipate, divinyl phthalate. Mixtures of two or more monomers can be used if desired. Preferred ethylenically unsaturated monomers include 1,4-butanediol diacrylate, N,N-dimethyl acrylamide, triethyleneglycol diacrylate, tetraethyleneglycol diacrylate, trimethylolpropane triacrylate, tetrahydrofurfuryl acrylate, N-vinyl pyrrolidone, isooctyl acrylate, N-vinyl caprolactam, 1,6-hexanediol diacrylate, and butyl acrylate.

The ethylenically unsaturated monomers polymerize or cure by a free radical polymerization mechanism. This polymerization is initiated by a free radical source and can be generated by electron beam radiation or by an appropriate curing agent or initiator. If a curing agent or initiator is employed, then a free radical source can be generated by exposing the curing agent or initiator to either heat or a radiation energy source. Examples of radiation energy sources include electron beam, ultraviolet light or visible light.

Cationically polymerizable materials that undergo cationic polymerization include 1,2-, 1,3- and 1,4-cyclic ethers (also designated as 1,2-, 1,3- and 1,4-epoxides), vinyl ethers, cyclic formals, and cyclic organosiloxanes.

The term cationically polymerizable monomer is meant to include monomeric materials, oligomeric materials or polymeric materials that contain an oxirane ring, that is

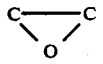

and the compound is polymerized by ring opening. This reaction is not a condensation reaction, but rather an opening of the epoxy ring initiated by an acidic or basic catalyst. Such materials may vary greatly in the nature of their backbones and substituent groups. For example, the backbone may be of any type such that there is an active hydrogen atom which is reactive with an oxirane ring at room temperature. Representative examples of acceptable substituent groups include halogens, ester groups, ether groups, sulfonate ester groups, siloxane groups, nitro groups, and phosphate ester groups. The molecular weight of the epoxy containing materials can vary from about 60 to about 4000, and preferably range from about 100 to about 600. Mixtures of various epoxy-containing materials can be used in the compositions of this invention.

Epoxy-containing materials that are particularly useful in the practice of this invention include glycidyl ether monomers of the formula

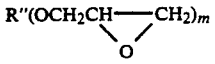

wherein R'' is an alkyl or aryl group and m is an integer of 1 to 6, inclusive. Representative examples of these are the glycidyl ethers of polyhydric phenols obtained by reacting a polyhydric phenol with an excess of a chlorohydrin, such as epichlorohydrin. Specific examples of such materials include 2,2-bis[4-(2,3-epoxypropoxy)-phenyl]propane (diglycidyl ether of bisphenol A) and commercially available materials under the trade designation "Epon 828", "Epon 1004" and "Epon 1001F" available from Shell Chemical Co., "DER-331", "DER-332" and "DER-334" available from Dow Chemical Co., flame retardant epoxy resins (e.g., "DER-580", a brominated bisphenol type epoxy resin available from Dow Chemical Co.), glycidyl ethers of phenol formaldehyde novolac (e.g., "DEN-431" and "DEN-428" available from Dow Chemical Co.), and resorcinol diglycidyl ether. Additional examples of epoxides of this type that can be used in the practice of this invention are described in U.S. Pat. No. 3,018,262, and in Lee and Neville, *Handbook of Epoxy Resins*, Appendix A (1967) and such descriptions are incorporated herein by reference.

Commercially available epoxy-containing materials useful in this invention include cycloaliphatic epoxide monomers such as the epoxycyclohexanecarboxylates, typified by 3,4-epoxycyclohexylmethyl 3,4-epoxycyclohexanecarboxylate, 3,4-epoxy-2-methylcyclohexylmethyl 3,4-epoxy-2-methylcyclohexanecarboxylate, bis(3,4-epoxy-6-methylcyclohexylmethyl) adipate, and 3,4-epoxy-6-methylcyclohexane, vinylcyclohexande dioxide, and bis(2,3-epoxycyclopentyl) ether. Other useful epoxides of this nature are described in U.S. Pat. No. 3,177,099 and such description is incorporated herein by reference.

Additionally commercially available epoxy-containing materials that can be used in the practice of this invention include octadecyl oxide, epichlorohydrin, styrene oxide, glycidol, butyl glycidyl ether, glycidyl acrylate and methacrylate, epoxy modified polypropylene glycol, peroxidized polybutadiene, silicone resins containing epoxy functionality, and copolymers of acrylic acid esters of glycidol, such as glycidyl acrylate and glycidyl methacrylate, with one or more copolymerizable vinyl compounds, such as methyl methacrylate, vinyl chloride, and styrene. Examples of such copolymers are 1:1 styrene:glycidyl methacrylate, 1:1 methyl methacrylate:glycidyl acrylate, and 62.5:24:13.5 methyl methacrylate:ethyl acrylate:glycidyl methacrylate.

The polymeric epoxides include linear polymers having terminal epoxy groups (e.g., a diglycidyl ether of a polyoxyalkylene glycol), polymers having skeletal oxirane units (e.g., polybutadiene polyepoxide), and polymers having pendant epoxy groups (e.g., glycidyl methacrylate polymer or copolymer). The epoxides may be individual compounds, but are generally mixtures containing one, two or more epoxy groups per molecule. The "average" number of epoxy groups per molecule is determined by dividing the total number of epoxy groups by the epoxy molecules present.

Other cationically-sensitive monomers that can be used in the present invention include vinyl ethers, such as vinyl methyl ether, vinyl ethyl ether, vinyl n-butyl ether, vinyl 2-chloroethyl ether, vinyl isobutyl ether, vinyl phenyl ether and vinyl 2-ethylhexyl ether, vinyl ethers of substituted aliphatic alcohols such as 1,4-di(ethenoxy)butane, vinyl 4-hydroxy-butyl ether; cyclic formals such as trioxane, 1,3-dioxolane, 2-vinyl-1,3-dioxolane, and 2,-methyl-1,3-dioxolane; and cyclic siloxanes that can contain various groups attached to the silicon atom such as a hydrocarbon radical (alkyl, aryl, alkaryl), an alkenyl hydrocarbon radical (vinyl, allyl or acryloyloxy-alkyl), a halogenated hydrocarbon radical, a carboxy-containing hydrocarbon radical or ester group, a cyanohydrocarbon radical, hydrogen, halogen or a hydroxy group.

When practicing the first method of the present invention, the preferred cationically polymerizable monomers are diglycidyl ethers of bisphenols. When practicing the second method of the present invention, the preferred cationically polymerizable monomers are cycloaliphatic epoxy monomers.

The polyisocyanate component of the polyurethane precursors of the invention may be any aliphatic, cycloaliphatic, aromatic or heterocyclic polyisocyanate, or any combination of such polyisocyanates, particularly suitable polyisocyanates correspond to the formula:

$$Q(NCO)_p$$

wherein p is an integer between 2 to 4, and Q represents an aliphatic hydrocarbon di-, tri-, or tetra- group containing from 2 to 100 carbon atoms, and zero to 50 heteroatoms, a cycloaliphatic hydrocarbon radical containing 4 to 100 carbon atoms and zero to 50 heteroatoms, an aromatic hydrocarbon radical or heterocyclic aromatic radical containing from 5 to 15 carbon atoms and zero to 10 heteroatoms, or an aliphatic hydrocarbon radical containing from 8 to 100 carbon atoms and zero to 50 heteroatoms. The heteroatoms that can be present in Q include non-peroxidic oxygen, sulfur, nonamino nitrogen, halogen, silicon, and non-phosphino phosphorus.

Examples of polyisocyanates are as follows: ethylene diisocyanate, 1,4-tetramethylene diisocyanate, 1,6-hexamethylene diisocyanate, 3,4,4-trimethyl hexamethylene diisocyanate, 1,12-dodecane diisocyanate, cyclobutane-1,3-diisocyanate, cyclohexane-1,3- and -1,4-diisocyanate and mixtures of these isomers, 1-isocyanato-3,3,5-trimethyl-5-isocyanatomethyl cyclohexane (see German Auslegenschrift No. 1,202,785, U.S. Pat. No. 3,401,190), 2,4- and 2,6-hexahydrotolylene diisocyanate and mixtures of these isomers, hexahydro-1,3- and/or -1,4-phenylene diisocyanate, perhydro-2,4'-and/or -4,4' diphenylmethane diisocyanate, 1,3- and 1,4-phenylene diisocyanate, 2,4- and 2,6-tolylene diisocyanate and mixtures of these isomers, diphenylmethane-2,4'- and-/or -4,4'-diisocyanate, naphthylene-1,5-diisocyanate, and the reaction products of four equivalents of the aforementioned isocyanate containing compound with a compound containing two isocyanate-reactive groups.

It is also within the scope of the present invention to use, for example, triphenylmethane-4,4',4''-triisocyanate, polyphenyl polymethylene polyisocyanates, m- and p-isocyanatophenylsulfonyl isocyanates, perchlorinated aryl polyisocyanates, polyisocyanates containing carbodiimide groups, norbornane diisocyanates, polyisocyanates containing allophanate groups, polyisocyanates containing isocyanurate groups, polyisocyanates containing urethane groups, polyisocyanates containing acrylated urea groups, polyisocyanates containing biuret groups, polyisocyanates prepared by telomerization reactions of the type described in U.S. Pat. No. 3,654,106, polyisocyanates containing ester groups, polyisocyanates containing polymeric fatty acid groups, and reactions products of any of the above mentioned diisocyanates with acetals; or mixtures of any of the above polyisocyanates.

Also useful are blocked polyisocyanates, many of which are commercially available, wherein the blocking group can be, for example, phenol, epsilon-caprolactam, hydroxamic acid ester, ketoxime, t-butyl acetoacetate and others as described in Wicks, Z. W., Jr. *Progress in Organic Coatings*, 9, 3-28 (1981).

Preferred polyisocyantes are aliphatic, such as hexamethylene diisocyante, the isocyanurate and the biuret thereof, such as those commerically available under the trade designation "DESMODUR N" (available from Mobay Corp.), 4,4'-methylenebis(cyclohexyl isocyanate); 1-isocyanato-3,3,5-trimethyl-5-isocyanatomethylcyclohexane (isophorone diisocyanate) and the biurets thereof; the tolylene diisocyanates and the isocyanurates thereof; the mixed isocyanurate of tolylene diisocyanate and hexamethylene diisocyanate; the reaction product of one mole of trimethylol propane and three moles of tolylene diisoscyanate and crude diphenylmethane diisocyanate.

Suitable isocyanate-reactive groups contain at least two isocyanate-reactive hydrogen atoms. They can be high or low molecular weight compounds having a weight average molecular weight of from about 50 to 50,000. Useful compounds are those including amino groups, thiol groups, carboxyl groups, and hydroxyl groups.

Preferably, isocyanate-reactive compounds containing hydroxyl groups, particularly compounds containing from about 2 to 50 hydroxyl groups, and more particularly, compounds having a weight of from about 200 to 25,000 more preferably from about 200 to 20,000, for example, polyesters, polyethers, polythioethers, polyacetals, polycarbonates, poly(meth)acrylates, and polyester amides, containing at least 2, generally from about 2 to 8, but preferably from about 2 to 4 hydroxyl groups, or even hydroxyl-containing prepolymers of these compounds. It is, of course, possible to use mixtures of the above-mentioned compounds containing at least two hydroxyl groups and having a molecular weight of from about 50 to 50,000 for example, mixtures of polyethers and polyesters.

Low molecular weight compounds containing at least two isocyanate-reactive hydrogen atoms (molecular weight from about 50 to 400) suitable for use in accordance with the present invention are compounds preferably containing hydroxyl groups and generally containing from about 2 to 8, preferably from about 2 to 4 isocyanate reactive hydrogen atoms. It is also possible to use mixtures of different compounds containing at least two isocyanate-reactive hydrogen atoms and having a molecular weight in the range of from about 50 to 400. Examples of such compounds are ethylene glycol, 1,2- and 1,3-propylene glycol, 1,4- and 2,3-butylene glycol, 1,5-pentane diol, 1,6-hexane diol, 1,8-octane diol, neopentyl glycol, 1,4-bis-hydroxymethyl cyclohexane, 2-methyl-1,3-propane diol, dibromobutene diol, glycerol, trimethylolpropane, 1,2,6-hexanetriol, trimethylolethane, pentaerythritol, quinitol, mannitol, sorbitol, diethylene glycol, triethylene glycol, teraethylene glycol, higher polyethylene glycols, dipropylene glycol, higher polypropylene glycols, dibutylene glycol, higher polybutylene glycols, 4,4'-dihydroxy diphenyl propane and dihydroxy methyl hydroquinone.

Other polyols suitable for the purposes of the present invention are the mixtures of hydroxy aldehydes and hydroxy ketones or the polyhydric alcohols obtained therefrom by reduction, which are formed in the autocondensation of formaldehyde, polymers thereof and hydrates thereof, in the presence of metal compounds as catalysts and compounds capable of enediol formation as co-catalysts.

Other isocyanate reactive compounds are polyols having molecular weights in the range of 200 to 20,000 grams per mole, and containing two or more primary hydroxyl groups per molecule.

Preferred polyols can be of hydroxylalkylated bisphenol derivatives. Preferred diols in this group can be represented by the formula:

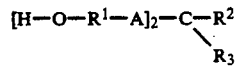

wherein $R^1$ is either a straight, branched, or cyclic alkylene (such as methylene, ethylene, and decylene) group having of 1 to 10 carbon atoms or an aralkylene group having of 7 to 14 carbon atoms such as benzylidene. $R^2$ and $R^3$ independently may be an alkyl groups, aralkyl group, cycloalkyl groups, alkaryl group, or an aryl group of 1 to 30 carbon atoms, preferably methyl, ethyl and trifluoromethyl, and zero or 1 to 10 heteroatoms, and $R^2$ and $R^3$ taken together can comprise alkylene groups, cycloalkylene groups, arylene group, alkarylene group, or aralkylene group containing 2 to 660 carbons atoms, and none or 1 to 10 heteroatoms. "A" can be a substituted or unsubstituted arylene groups, preferably having 6 to 12 carbon atoms, most preferably p-phenylene, o-phenylene, and dimethylnaphthalene.

Specific preferred hydroxyalkylated bisphenols are 2,2-bis-4-(2-hydroxyethoxyphenyl)butane, hydroxyethylated bisphenol of butanone, 2,2-bis-4-(2-hydroxyethoxyphenyl)hexafluoropropane and 1,2-bis-4-(2-hydroxyethoxyphenyl)propane, 2,2-bis4-(2-hydroxyethoxyphenyl)norbornane, 2,2-bis-4-(2-hydroxyethoxyphenyl)-5,6-cyclopentanorbornane and 1,1-bis-4-(2-hydroxyethoxyphenyl)cyclohexane. Polyurethanes prepared from the polyurethane precursors and useful in the present invention preferably have a glass transition temperature of greater than room temperature and more preferably greater than 70° C.

Another group of monomers which are useful in compositions of the invention are bireactive monomers that serve as crosslinkers, that is, those that possess at least one free-radically polymerizable group and one isocyanate or isocyanate reactive functionality. Such monomers include, for example, 2-isocyanatoethyl methacrylate, 3-isopropenylphenyl isocyanate, hydroxyethyl acrylate, hydroxyethyl methacrylate, hydroxypropyl methacrylate and hydroxybutyl acrylate. Bireactive monomers can comprise up to 25 mole percent of the isocyanate or isocyanate-reactive groups, preferably they can comprise less than 5 mole percent of the isocyanate reactive groups and up to 50 mole percent of free-radically polymerizable monomers, preferably less than 25 mole percent of free-radically polymerizable monomers. Most preferably, the compositions are free of bireactive monomers.

Weight ratios of the make coat precursor typically range from about 5 to 95 parts by weight, preferably 40 to 85 parts by weight of ethylenically unsaturated monomer, and 5 to 95 parts by weight, preferably 15 to 60 parts by weight of either the cationically polymerizable monomer or the polyurethane precursor. Additionally, the curing agent for the ethylenically unsaturated monomer, and the cationically polymerizable monomer or the polyurethane precursor is typically less than 20 parts by weight, preferably less than 8 parts by weight, more preferably less than 4 parts by weight.

The abrasive grains of the invention have a Moh hardness of at least 7, preferably at least 8. Typical examples of abrasive grains include aluminum oxide, heat treated aluminum oxide, ceramic aluminum oxide, silicon carbide, diamond, alumina zirconia, cerium oxide, boron carbide, cubic boron nitride, garnet and mixtures thereof. The abrasive grains can be applied by drop coating or preferably by electrostatic coating.

A size coat precursor applied over the abrasive grains and the make coat precursor may be any resinous or glutinous adhesive. Examples of such size coat precursors include phenolic resins, urea-formaldehyde resins, melamine resins, acrylate resins, urethane resins, epoxy monomers, polyester resins, aminoplast resins and combinations and mixtures thereof. The size coat precursor can comprise a cationically polymerizable monomer, an ethylenically unsaturated monomer, a mixture of each, or a mixture of cationically polymerizable monomers ethylenically unsaturated monomers. The preferred size coat precursor is a phenolic resin or an epoxy monomer. The size coat can be applied by any conventional techniques known to those skilled in the art and include but are not limited to roll coating, die coating, curtain coating and preferably spray coating.

The make coat precursor and/or the size coat precursor of the invention can additionally contain optional additives that are well known in the coated abrasive art. These additives include fillers, fibers, lubricants, grinding aids, wetting agents, surfactants, colorants, coupling agents, plasticizers, and suspending agents. Preferred fillers include calcium carbonate, calcium oxide, calcium metasilicate, alumina trihydrate, cryolite, magnesia, kaolin, quartz, and glass. Fillers that function as grinding aids are cryolite, potassium fluoroborate, feldspar, and sulfur. The fillers can be used in amounts up to about 250 parts, preferably from about 30 to about 150 parts, per 100 parts of the make or size coat precursor while retaining good flexibility and toughness of the cured binder. The amounts of these materials are selected to give the properties desired.

The preferred curing agent for both the cationically polymerizable monomer and the polyurethane precursor are salts of organometallic complex cations, such as described in European Patent Application 109,581 (cationically polymerizable monomers) and U.S. Pat. Nos. 4,740,577 (polyurethane precursors) and 5,059,701 (cationically polymerizable monomers and polyurethane precursors). Another example of a curing agent is a mixture of a salt of organometallic complex cation and an onium salt as described in U.S. Pat. No. 4,985,340 and such description is incorporated herein by reference.

Suitable salts of organometallic complex cations include but are not limited to, those salts having the following formula:

$$[(L^1)(L^2)M^P]^{+q}Y_n$$

wherein $M^P$ represents a metal selected from the group consisting of Cr, Mo, W, Mn Re, Fe, and Co;

$L^1$ represents 1 or 2 ligands contributing pi-electrons that can be the same or different ligand selected from the group of: substituted and unsubstituted eta$^3$-allyl, eta$^5$-cyclopentadienyl, and eta$^7$-cycloheptatrienyl, and eta$^6$-aromatic compounds selected from eta$^6$-benzene and substituted eta$^6$-benzene compounds and compounds having 2 to 4 fused rings, each capable of contributing 3 to 8 pi-electrons to the valence shell of $M^p$;

$L^2$ represents none, or 1 to 3 ligands contributing an even number of sigma-electrons that can be the same or different ligand selected from the group of: carbon monoxide, nitrosonium, triphenyl phosphine, triphenyl stibine and derivatives of phosphorus, arsenic and antimony, with the proviso that the total electronic charge contributed to $M^p$ results in a net residual positive charge of q to the complex;

q is an integer having a value of 1 or 2, the residual charge of the complex cation;

Y is a halogen-containing complex anion selected from $BF_4^-$, $AsF_6^-$, $PF_6^-$, $SbF_5OH^-$, $SbF_6^-$, and $CF_3SO_3^-$; and n is an integer having a value of 1 or 2, the number of complex anions required to neutralize the charge q on the complex cation;

Examples of suitable salts of organometallic complex cations useful in the composition of the invention include the following:

(eta$^6$-benzene)(eta$^5$-cyclopentadienyl)iron(1+) hexafluoroantimonate (eta$^6$-toluene)(eta$^5$-cyclopentadienyl)iron(1+) hexafluoroarsenate (eta$^6$-cumene)(eta$^5$-cyclopentadienyl)iron(1+) hexafluorophosphate (eta$^6$-p-xylene)(eta$^5$-cyclopentadienyl)iron(1+) hexafluoroantimonate (eta$^6$-xylenes(mixed isomers))(eta$^5$-cyclopentadienyl) iron (1+) hexafluoroantinomate (eta$^6$-xylenes(mixed isomers))(eta$^5$-cyclopentadienyl) iron (1+) hexafluorophosphate (eta$^6$-o-xylene)(eta$^5$-cyclopentadienyl)iron(1+) triflate (eta$^6$-m-xylene)(eta$^5$-cyclopentadienyl)iron(1+) tetrafluoroborate (eta$^6$-mesitylene)(eta$^5$-cyclopentadienyl)iron(1+) hexafluoroantimonate (eta$^6$-hexamethylbenzene)(eta$^5$-cyclopentadienyl-)iron(1+) pentafluorohydroxyantimonate (eta$^6$-naphthalene)(eta$^5$-cyclopentadienyl)iron(1+) tetrafluoroborate (eta$^6$-pyrene)(eta$^5$-cyclopentadienyl)iron(1+) triflate (eta$^6$-perylene)(eta$^5$-cyclopentadienyl)iron(1+) hexafluoroantimonate (eta$^6$-chrysene)(eta$^5$-cyclopentadienyl)iron(1+) pentafluorohydroxyantimonate (eta$^6$-acetophenone)(eta$^5$-methylcyclopentadienyl-)iron(1+) hexafluoroantimonate (eta$^6$-fluorene)(eta$^5$-cyclopentadienyl)iron(1+) hexafluoroantimonate Examples of preferred salts of organometallic complex cations useful in the composition of the invention include one or more of the following:

(eta$^6$-xylenes(mixed isomers))(eta$^5$-cyclopentadienyl) iron (1+) hexafluoroantinomate (eta$^6$-xylenes(mixed isomers))(eta$^5$-cyclopentadienyl) iron (1+) hexafluorophosphate (eta$^6$-m-xylene)(eta$^5$-cyclopentadienyl)iron(1+) tetrafluoroborate (eta$^6$-o-xylene)(eta$^5$-cyclopentadienyl)iron(1+) hexafluoroantimonate (eta$^6$-p-xylenes)(eta$^5$-cyclopentadienyl)iron(1+) triflate (eta$^6$-mesitylene)(eta$^5$-cyclopentadienyl)iron(1+) hexafluoroantimonate (eta$^6$-cumene)(eta$^5$-cyclopentadienyl)iron(1+) hexafluorophosphate (eta$^6$-mesitylene)(eta$^5$-cyclopentadienyl)iron(1+) pentafluorohydroxyantimonate (eta$^6$-toluene)(eta$^5$-cyclopentadienyl)iron(1+) hexafluoroarsenate The curing agent for cationically polymerizable monomers may include a salt having an onium cation and a halogen-containing complex anion of a metal or metalloid as described in U.S. Pat. No. 4,751,138 and such description is incorporated herein by reference.

While it is not preferred, it would be within the scope of the present invention to cure the cationically polymerizable monomers or the polyurethane precursor using suitable curing agents, such as those that are thermally-activated. Epoxy curing agents include, but are not limited to aliphatic and aromatic primary amines; Lewis acids, such as aluminum trichloride, aluminum tribromide, boron trifluoride, antimony pentafluoride, titanium trifluoride. Further, boron trifluoride complexes, such as $BF_3^-$ monoethanolamine; imidazoles, such as 2-ethyl-4-methylimidazole; hydrazides, such as aminodihydrazide; guanidines, such as tetramethyl guanidine; dicyandiamide; and polybasic acids and their anhydrides. Such polyurethane precursor curing agents include, but are not limited to conventional catalysts, including tertiary amines, and tin and bismuth salts.

Examples of curing agents or initiators, that generate a free radical source when exposed to ultraviolet light radiation energy include quinones, benzophenones, nitroso compounds, acryl halides, hydrazones, benzoin ethers, benzil ketals, thioxanthones, and acetophenone derivatives. Additional references to free radical photoinitiator systems for ethylenically unsaturated compounds are included in U.S. Pat. No. 3,887,450 and U.S. Pat. No. 3,895,949. For ultraviolet light curing, in order to fully polymerize the ethylenically unsaturated monomer, the make coat precursor should be exposed to an energy level at least between 100 to 700 milliJoules·cm$^{-2}$, preferably between 400 to 600 milliJoules·cm$^{-2}$.

Optionally, it is within the scope of this invention to include photosensitizers or photoaccelerators in the polymerizable compositions. Use of photosensitizers or photoaccelerators alters the wavelength sensitivity of radiation sensitive compositions. This is particularly advantageous when the photoinitiator employed does not strongly absorb the incident radiation. Use of a photosensitizer or photoaccelerator increases the radiation sensitivity, allowing shorter exposure times and/or the use of less powerful sources of radiation. Any photosensitizer or photoaccelerator may be useful if its triplet energy is at least 45 kilocalories per mole. Examples of such photosensitizers include pyrene, fluoranthrene, xanthone, thioxanthone, benzophenone, acetophenone, benzil, benzoin and ethers of benzoin, chrysene, p-terphenyl, acenaphthene, naphthalene, phenanthrene, biphenyl, substituted derivatives of the preceding compounds, and the like. When present, the amount of photosensitizer or photoaccelerator used in the practice of this invention is generally in the range of 0.01 to 10 parts by weight, and preferably 0.1 to 10 parts by weight of photosensitizer or photoaccelerator per part of curing system.

When the make coat or size coat precursor contains at least one epoxy monomer, it is also within the scope of the present invention, provided there is no polyurethane precursor present in the make or size coat precursor, to add a catalytically effective amount of a thermally decomposable ester reaction product of a tertiary alcohol and an acid. In general, the thermally decomposable ester reaction products of a tertiary alkyl alcohol and an acid that forms a chelation complex with the metal ion of the organometallic complex salt useful in the invention are soluble compounds that upon heating, preferably to a temperature in the range of 60° to 125° C., decompose to release the chelating acid. While not intending to be bound by theory, it is believed that the released acid forms a nonionizing chelation complex with the metal atom, the chelation reaction tends to remove metal atoms from a solution of the photolysed cationic organometallic salt. Thereupon, the acid of the salt anion is released for reaction to catalyze polymerization of the polymerizable material in the system.

The ester reaction products are prepared from tertiary alkyl alcohols and any tertiary alkyl alcohol that forms an ester reaction product with an appropriate acid may be used. Examples of suitable tertiary alkyl alcohols are t-butanol, 1,1-dimethylpropanol, 1-methyl-2-ethylpropanol, 1,1-dimethyl-n-butanol, 1,1-dimethyl-n-octanol, 1,1-diphenylethanol, 1,1-dibenzyl ethanol, 1,1-dimethyl-n-pentanol, 1,1-dimethylisobutanol, 1,1,2,2,-tetramethylpropanol, 1-methylcyclopentanol, 1-methylcyclohexanol, and 1,1-dimethyl-n-hexanol.

Preferred chelating acids for inclusion in acid generating esters of the invention are oxalic, phosphoric and phosphorous acids. Other illustrative chelating acids that are useful include polycarboxylic acids, for example, malonic, succinic, fumaric, maleic, citraconic, aconitic, o-phthalic, trimesic acids and other polycarboxylic acids having less than 3 carbon atoms separating carboxylic groups; hydroxycarboxylic acids, for example, glycolic, lactic, beta-hydroxybutyric, gamma-hydroxybutyric, tartronic, malic, oxalacetic, tartaric, and citric acids; aldehydic and ketonic acids, for example, glyoxylic, pyruvic, and acetoacetic acids; other acids of phosphorus, chromic acid and vanadic acid.

The acid-generating esters may be prepared by procedures well known in the art. For example, acid-generating esters that incorporate the organic acids may be prepared by procedures described by Karabatsos et al. *J. Org. Chem.* 30, 689 (1965). Esters that incorporate phosphate, phosphonate and phosphite esters can be prepared by procedures described by Cox, Jr. *J. Am. Chem. Soc'y* 80, 5441 (1958); Goldwhite *J. Am. Chem. Soc'y* 79, 2409 (1957); and Cox, Jr. *J. Org. Chem.* 54, 2600 (1969), respectively.

The acid-generating ester should be relatively nonhydrolyzable and be essentially free of acid. To remove traces of acid from the acid-generating ester, it may be passed through a column filled with an ion exchange resin.

Also useful in accelerating the cationic polymerization when used in combination with a salt of an organometallic complex cation and the acid generating ester are peroxides: acylperoxides, such as benzoyl peroxides; alkyl peroxides, such as t-butylperoxide; hydroperoxides, such as qumyl hydroperoxide; peresters, such as t-butyl perbenzoate; di-alkyl peroxydicarbonates, such as di-(sec-butyl)peroxydicarbonate; diperoxy ketals; and ketone peroxides, such as methyethylketone peroxide.

A free radical curing agent is not required for electron beam curing of an ethylenically unsaturated monomer, although one may be added. For electron beam curing, in order to fully polymerize the ethylenically unsaturated monomer, the make coat precursor should be exposed to a dosage level of 1 to 10 Mrad at an accelerating potential of between 150 to 300 KeV.

The make and size coat precursors are exposed to an energy source to initiate the polymerization of either the cationically polymerizable monomer or the polyurethane precursor. This exposure may cause the cationically polymerizable monomer or the polyurethane precursor to become only partially cured, that is, the polymerization has been started but not yet completed. Alternatively, the exposure to the energy source may cause the cationically polymerizable monomer or the polyurethane precursor to become fully cured. If the polymerization has been started, it may be fully completed by allowing the make and size coat precursors to stand at room temperature (that is, no additional energy is introduced into the make coat precursor) for a period of time. This time may range from several hours to several days. This time delay is not preferred due to the associated economics.

This energy source can be thermal, which includes both infrared and heat, or radiation energy, which includes electron beam, ultraviolet light and visible light. The time and the amount of energy required to initiate the polymerization or to fully polymerize depends upon the actual materials forming the make coat precursor, type of curing agent, the density and thickness of the make coat precursor.

For thermal curing such as heat, in order to initiate the polymerization of either the cationically polymerizable monomer or the polyurethane precursor, the make coat precursor should be heated for about 1 to 150 minutes at between 30° to 125° C., preferably 50° to 100° C. For full polymerization of either the cationically polymerizable monomer or the polyurethane precursor, the make coat precursor should be heated for about 5 to 200 minutes at between 50° to 125° C., preferably 75° to 100° C.

Electron beam radiation is also known as ionizing radiation and consists of accelerated particles. For electron beam curing, in order to initiate the polymerization of either the cationically polymerizable monomer or the polyurethane precursor, the make coat precursor or radiation-curable size coat precursor should be exposed to a dosage level of 0.1 to 5 Mrad at an accelerating potential of between 100 to 300 KeV. For full polymerization of either the cationically polymerizable monomer or the polyurethane precursor, the make coat precursor or radiation-curable size coat precursor should be exposed to a dosage level of 1 to 10 Mrad at an accelerating potential of between 150 to 300 KeV.

Ultraviolet light radiation means non-particulate radiation having a wavelength within the range of 200 to 400 nanometers, more preferably between 350 to 400 nanometers. For ultraviolet light curing, in order to initiate the polymerization of either the cationically polymerizable monomer or the polyurethane precursor, the make coat precursor is exposed to an energy level of at least between 100 to 700 milliJoules·cm$^{-2}$, preferably between 400 to 600 milliJoules·cm$^{-2}$. For full polymerization of either the cationically polymerizable monomer or the polyurethane precursor, this energy level may be the same or higher.

Visible light radiation means non-particulate radiation having a wavelength within the range of 400 to 800 nanometers, more preferably between 400 to 550 nanometers. For visible light curing, in order to initiate the polymerization of either the cationically polymerizable monomer or the polyurethane precursor, the make coat precursor is exposed to an energy level of at least between 100 to 700 milliJoules·cm$^{-2}$, preferably between 400 to 600 milliJoules·cm$^{-2}$. For full polymerization of either the cationically polymerizable monomer or the polyurethane precursor, the make coat precursor should be exposed to visible light for 5 to 60 seconds, preferably 10 to 30 seconds.

Visible light is the preferred energy source to initiate the polymerization of either the cationically polymerizable monomer or the polyurethane precursor. The polymerization of the ethylenically unsaturated monomer is typically achieved by the exposure to an ultraviolet light energy source. Thus, when the make coat precursor is exposed to the visible light energy source, the polymerization of the cationically polymerizable monomer or the polyurethane precursor is initiated, but not the polymerization of the ethylenically unsaturated monomer.

For thermal curing, the make coat precursor should be heated for about 1 to 150 minutes at between 30° to 125° C., preferably between about 50° to 100° C. For electron beam curing, in order to initiate the polymerization of the ethylenically unsaturated monomer, the make coat precursor should be exposed to a dosage level of 0.1 to 5 Mrad at an accelerating potential of between 1 to 300 KeV. For ultraviolet light curing, in order to initiate the polymerization of the ethylenically unsaturated monomer, the make coat precursor should be exposed to an energy level of at least between 100 to 700 milliJoules·cm$^{-2}$, preferably between 400 to 600 milliJoules·cm$^{-2}$. For visible light curing, in order to initiate the polymerization of the ethylenically unsaturated monomer, the make coat precursor should be exposed to an energy level of at least between 100 to 700 milliJoules·cm$^{-2}$, preferably between 400 to 600 milliJoules·cm$^{-2}$.

In order to fully cure the ethylenically unsaturated monomer, the make coat precursor is exposed to an energy source. This energy source during the fabrication of the coated abrasive article of the present invention can be thermal, which includes both infrared and heat, or radiation energy, which includes electron beam, ultraviolet light or visible light. The ethylenically unsaturated monomer polymerizes via a free radical mechanism. For the thermal, ultraviolet light and visible light energy sources, a curing agent is required for the ethylenically unsaturated monomer for the polymerization to begin. The time and the amount of energy required to fully polymerize depends upon the actual ethylenically unsaturated monomer, type of curing agent for the ethylenically unsaturated monomer, and the density and thickness of the make coat precursor. It is preferred, during this full curing step, to minimize the amount of oxygen present. One means to accomplish this, is to cure the precursor in a nitrogen atmosphere. Another means is to knife-coat the make coat precursor and cover the make coat precursor with a transparent polymeric film. The curing step(s) are then done with the polymeric film over the make coat precursor. If a polymeric film is used, the film needs to be removed prior to application of the abrasive grains.

In the first method for making a coated abrasive article of the present invention, it is preferable that (1) the make coat is applied to a backing, (2) then exposing the make coat to an energy source to activate the cationically polymerizable monomer or polyurethane precursor initiator, (3) partially polymerizing, either sequentially or simultaneously, the cationically polymerizable monomer or the polyurethane precursor; the ethylenically unsaturated monomer; or both, and (4) then applying a plurality of abrasive grains. Advantageously, applying a size coat precursor, and fully curing both the make coat precursor and the size coat precursor may be accomplished in any order. For example, the make coat precursor could be fully cured prior to application of the size coat precursor and subsequent full cure of the size coat precursor. Alternatively, the size coat precursor can be coated over the layer of abrasive grains and then both the size coat precursor and the make coat precursor are fully cured. Partially polymerizing the make coat precursor prior to the application of abrasive grains, permits a substantially monolayer of grains. The partially polymerized make coat precursor is a pressure-sensitive adhesive like layer. The layer has sufficient "tack" to hold the abrasive grains during application and curing of the size coat, resulting in a substantially monolayer of abrasive grains. The degree of "tack" can vary with the size of the grain. For example, a large abrasive grain will generally require a greater degree of tack than a small abrasive grain. One advantage of the present invention is that the make coat precursor layer, once partially polymerized is sufficiently tacky to hold the abrasive grains and does not display a viscosity that will wet and wick up the abrasive grains.

In the second method for making a coated abrasive article of the present invention, (1) the make precursor is applied to a backing, (2) the make coat precursor is then exposed to an energy source to fully cure the precursor, (3) a plurality of abrasive grains are applied, and (4) a size coat is applied and cured. The make coat, although fully polymerized, is a pressure sensitive adhesive, typically having the properties of (1) being tacky, (2) exerting a strong holding force, (3) having sufficient cohesiveness and elasticity that it can be removed from smooth surfaces without leaving a visible residue, and (4) requiring no activation by water, solvent or heat to become tacky. The make coat has sufficient "tack" to hold the abrasive grains during the application and curing of the size coat. The degree of "tack" can vary with the size of the grain. For example, a large abrasive grain will generally require a greater degree of tack than a small abrasive grain. One advantage of the present invention is that the make coat precursor layer, once polymerized is sufficiently tacky to hold the abrasive grains and does not display a viscosity that will wet and wick up the abrasive grains. It is contemplated that any viscoelastic material that in solvent-free form remains permanently tacky and adheres instantaneously to most solid surfaces with the application of very slight pressure would be within the scope and principles of the present invention. Such pressure-sensitive adhesives are recognized as possessing a "four-fold balance" of adhesion, cohesion, stretchiness, and elasticity. See Houwink and Salomon, *Adhesion and Adhesives* (Elsevior Publishing Co. 1967).

In the preferred embodiment of the second method for making a coated abrasive article of the present invention, it is preferable that (1) the make coat is applied to a backing, (2) then exposing the make coat to an energy source to activate, either sequentially or simultaneously, the cationically polymerizable monomer or the polyurethane precursor; the ethylenically unsaturated monomer; or both, (3) fully curing the make coat precursor, (4) then applying a layer of abrasive grains, (5) applying a size coat precursor of the layer of abrasive grains and (6) fully curing the size coat precursor. In order to have a make coat with this pressure sensitive adhesive properties, the proper selection of the ethylenically unsaturated monomer and either the cationically polymerizable monomer or the polyurethane precursor is beneficial. Typically, the ethylenically unsaturated monomer will be predominantly monofunctional, and the cationically polymerizable monomer, preferably cycloaliphatic epoxy monomers, and polyurethane will have a functionality greater than 2 on the average. It is generally preferred that the size coat precursor be cured upon application to prevent penetration of the size coat precursor into the fully cured make coat.

Objects and advantages of this invention are further illustrated by the following examples, but the particular materials and amounts thereof recited in these examples, as well as other conditions and details, should not be construed to unduly limit this invention.

EXAMPLES

All coating weights are specified in grams/square meter. All formulations ratios are based upon parts by weight. All materials are commerically available or known in the literature unless otherwise stated or apparent.

| GLOSSARY | |
|---|---|
| IOA | isooctyl acrylate |
| NVP | N-vinyl pyrrolidone |
| PH1 | 2,2-dimethoxy-1,2-diphenyl-1-ethanone (Irgacure TM 651, commercially available from Ciba-Geigy, or KB-1 commercially available from Sartomer) |
| HPA | 2,2,-bis-4-(2-hydroxyethyoxyphenyl)hexafluoro-propane(hydroxyethylated bisphenol A) |
| HDODA | 1,6-hexanediol diacrylate |
| PH2 | eta$^6$-(xylenes (mixed isomers))-eta$^5$-cyclopentadienyl-iron(1+)hexafluorophosphate |
| TEGDA | tetraethylene glycol diacrylate (commercially available from Sartomer under the trade designation "SR-268") |
| BDDA | butanediol diacrylate (commercially available from Sartomer under the trade designation "SR-313") |
| PUP1 | a biuret of 1,6-hexamethylene diisocyanate (commercially available from Mobay Corp. under the trade designation "Desmodur N-100") |
| IPDI | isophorone diisocyanate |
| EM1 | bis-(3,4-epoxy-6-methylcyclohexylmethyl)adipate (commercially available from Union Carbide under the trade designation ERL 4229) |
| PH3 | eta$^6$-(xylenes (mixed isomers))-eta$^5$-cyclopentadienyliron(1+)hexafluoroantinomate |
| RP1 | a resole phenolic resin (70% solids in water/2-ethoxy ethanol) |
| RP2 | a resole phenolic resin (75% solids in water/2-ethoxy ethanol) |
| PP | a polyester resin (a plasticizer for the resol phenolic resin) |
| BA | n-butyl acrylate |
| THFA | tetrahydrofurfuryl acrylate (commercially available from Sartomer under the trade designation "SR-285") |
| EM2 | a bisphenol A epoxy resin (commercially available from Shell Chemical under the trade designation "Epon 828" - epoxy equivalent wt. of 185–192 g · eq$^{-1}$) |
| EM3 | a bisphenol A epoxy resin (commercially available from Shell Chemical under the trade designation "Epon 1001F" - epoxy equivalent wt. of 525–550 g · eq$^{-1}$) |
| tBOX | di-t-butyl oxalate |
| EM4 | 3,4-epoxycyclohexylmethyl 3,4-epoxycyclohexanecarboxylate (commercially available from Union Carbide under the trade designation "ERL 4221") |
| PH4 | eta$^6$-(cumene)-eta$^5$-cyclopentadienyliron(1+) hexafluorophosphate (commercially available from Ciba-Geigy under the trade designation "Irgacure 261") |
| WA | a wetting agent (commercially available from Akzo Chemie America Interstab Chemicals under the trade designation "Interwet 33") |

The following test procedures were used to test the coated abrasive made according to the examples.

DISC TEST PROCEDURE I

The coated abrasive article was converted into a 10.2 cm diameter disc and secured to a foam back up pad with a pressure sensitive adhesive. The coated abrasive disc and back up pad assembly was installed on a Schiefer testing machine and the coated abrasive disc abraded "PLEXIGLAS" (polymethyl methacrylate). The load was 4.5 kg. All of the testing was done underneath a water flood. The total amount of "PLEXIGLAS" removed and the surface finish (Ra and Rtm) of the plexiglass workpiece were measured at various revolutions or cycles of the coated abrasive disc. "Ra" is the arithmetic average of the scratch size in microinches. "Rtm" is the average measured over five consecutive sampling lengths of the maximum peak to valley height in each sampling length. In some instances the surface finish was not measured.

DISC TEST PROCEDURE II

The Disc Test Procedure II follows Disc Test Procedure I, except the grinding was done dry, that is, no water flood.

DISC TEST PROCEDURE III

The coated abrasive article was converted into a 7.6 cm diameter disc and secured to a foam back up pad with a pressure sensitive adhesive. The coated abrasive disc and back up pad assembly was installed on a Schiefer testing machine. The coated abrasive disc abraded a 1018 mild steel ring workpiece having a 10.2 cm outer diameter and a 6.4 cm inner diameter. The load was 4.5 kg. All of the testing was done dry, that is, no water present. The total amount of mild steel removed was measured at various revolutions or cycles of the coated abrasive disc.

DISC TEST PROCEDURE IV

The Disc Test Procedure IV follows Disc Test Procedure I, except that the coated abrasive was converted into a 7.6 cm diameter disc. Additionally, the workpiece was a ring having a 10.2 cm outer diameter and a 5.1 cm inner diameter.

PREPARATION EXAMPLE 1

Into a glass jar were charged and thoroughly mixed with a magnetic stirrer 80 parts IOA, 20 parts NVP and 0.04 part PH1. The resulting mixture was then degassed to remove oxygen by bubbling nitrogen gas through the solution for at least five minutes. The mixture was then exposed to a Black-Ray lamp for about 45 seconds to prepolymerize the materials to a viscosity between 1000 to 3000 centipoise, using a Brookfield viscometer with a No. LV2 spindle at a rotation setting of 6, at 21° C. The resulting material was designated FA.

PREPARATION EXAMPLE 2

Into a glass jar were charged and thoroughly mixed with a magnetic stirrer 36 parts BA, 24 parts THFA and 0.024 part PH1. The resulting mixture was then degassed to remove oxygen by bubbling nitrogen gas through the solution for at least five minutes. The mixture was then exposed to a Black-Ray lamp for about 45 seconds to prepolymerize the materials to a viscosity about 2000 centipoise, using a Brookfield viscometer with a No. LV2 spindle at a rotation setting of 6, at 21° C. The resulting material was designated FB.

PREPARATION EXAMPLE 3

The material was prepared according to Preparation Example 1 except 70 parts IOA, 15 parts NVP, and 0.04 part PH1 were charged into the glass jar. The resulting material was designated FC.

PREPARATION EXAMPLE 4

The material was prepared according to Preparation Example 1 except 100 parts IOA and 0.04 parts PH1 were charged into the glass jar. The resulting material was designated FD.

EXAMPLES 1-2 AND COMPARATIVE EXAMPLES 1-2

This set of Examples compared various make coat precursor formulations. The resulting coated abrasives were tested according to the Disc Test Procedure I and the results are summarized in Table 1.

EXAMPLE 1

A make coat precursor was prepared by thoroughly mixing 85 parts of FA and 15 parts HPA at 80° C. Then 0.1 part of HDODA, 0.1 part of PH1 and 0.05 part of PH2 were thoroughly mixed into the make coat precursor. Just prior to coating, the make coat precursor was heated in a water bath at 90° C. Next, 7.5 parts of PUP1 and 7.5 parts of IPDI were then thoroughly mixed into the make coat precursor. The resulting make coat precursor was degassed under vacuum in a desiccator to remove air bubbles and dissolved oxygen. The make coat precursor was then knife-coated to a thickness of 0.05 millimeters (mm) onto an A weight waterproof paper. A release-coated polyester film cover-sheet was placed over the make coat precursor during knife-coating and subsequent processing. The make coat precursor was then irradiated at 0.5 meters/minute ($m \cdot min^{-1}$) with two 300 Watt flood lights followed by 600 milliJoules/$cm^2$ ($mJ \cdot cm^{-2}$) of ultraviolet light. The cover sheet was then removed and grade 600 silicon carbide abrasive grain was drop coated into the make coat precursor. The abrasive grain layer had an average weight of 17 $g \cdot m^{-2}$. The resulting product was thermally cured at 100° C. for about 10 minutes. Subsequently, a size coat precursor was sprayed over the abrasive grains. The size coat precursor had an average weight of 8 $g \cdot m^{-2}$. The size coat precursor was 30% solids in ethanol of a 90:10 ratio of RP1:PP. The resulting product was precured for one hour at 88° C. and final cured for about 90 minutes at 115° C.

EXAMPLE 2

A coated abrasive was prepared according to Example 1 except the make coat precursor was 80 parts of FD, 20 parts of EM1, 1 part of PH1, 0.5 part of PH3 and 0.1 part of HDODA.

COMPARATIVE EXAMPLE 1

Comparative Example 1 was a grade 600 Tri-M-ite Wetordry Type W coated abrasive (commercially available from the 3M Co.,St. Paul, Minn.).

COMPARATIVE EXAMPLE 2

The coated abrasive was prepared according to Example 1 except the make coat precursor was 80 parts of FA, 1 part of PH1 and 0.1 part of HDODA.

TABLE 1

| Example | No. of Cycles | Cumulative Cut (g) | Surface Finish (Ra/Rtm) |
|---|---|---|---|
| 1 | 500 | 0.998 | 10/58 |
| | 1000 | 1.615 | 8/46 |
| | 2000 | 2.195 | 5/30 |
| 2 | 500 | 1.191 | 10/63 |
| | 1000 | 2.094 | 9/56 |
| | 2000 | 3.155 | 7/49 |
| C1 | 500 | 0.958 | 12/68 |
| | 1000 | 1.781 | 9/60 |
| | 2000 | 2.773 | 8/50 |
| C2 | 500 | 0.754 | 8/43 |
| | 1000 | 1.206 | 5/30 |
| | 2000 | 1.589 | 4/30 |

EXAMPLES 3-5

This set of Examples compared various coated abrasive constructions. The resulting coated abrasives were tested according to the Disc Test Procedure IV and the results are summarized in Table 2.

EXAMPLE 3

The make coat precursor was prepared according to Example 1 and applied to a backing in a similar manner as described in Example 1. The make coat precursor was irradiated at 0.5 $m \cdot min^{-1}$ with visible light using four bulbs from a copying machine. The temperature underneath these bulbs was approximately 90° C. After the exposure to the visible light, the make coat precursor/backing was heated for 5 minutes at 90° C., followed by exposure to 600 $mJ \cdot cm^{-2}$ of ultraviolet light. The cover sheet was then removed and grade 600 silicon carbide abrasive grain was electrostatically coated into the make coat precursor. The abrasive grain layer had an weight of 13 $g \cdot m^{-2}$. The resulting product was thermally cured at 100° C. for about 10 minutes. A size coat precursor was sprayed over the abrasive grains. The size coat precursor had an average weight of 15 $g \cdot m^{-2}$. The size coat precursor was 30% solids in ethanol of a 90:10 ratio of RP1:PP. The resulting product was precured for one hour at 88° C. and final cured for about 90 minutes at 115° C.

EXAMPLE 4

A make coat precursor was prepared by thoroughly mixing the contents of FB 60 parts with 20 parts of EM2, 20 parts of EM3, 4 parts of cyclohexanedimethanol, 1 part of PH1, 1 part of PH3 and 1 part of tBOX. The resulting make coat precursor was degassed. The make coat precursor was then knife-coated to a thickness of 0.5 mm onto an A weight waterproof paper. A release-coated polyester film cover sheet was placed over the make coat precursor during knife-coating and subsequent processing. The make coat precursor was then irradiated with 600 $mJ \cdot cm^{-2}$ of ultraviolet light. The cover sheet was removed and grade 600 silicon carbide abrasive grain was electrostatically coated into the make coat precursor. The abrasive grain layer had an average weight of 13 $g \cdot m^{-2}$. The size coat used was the same as described in Example 1. The coated abrasive article was then precured and cured according to the procedures of Example 1.

EXAMPLE 5

A coated abrasive article was prepared according to Example 4 except the size coat was prepared with 90 parts of EM4, 10 parts of HDODA, 0.25 part of PH3 and 0.25 part of PH1. The size coat was diluted to 70% solids in methyl ethyl ketone (MEK) and sprayed over the abrasive grains/make coat precursor. The size coat had an average coating weight of 15 $g \cdot m^{-2}$. The size coat precursor was then exposed to a 120 $Watts \cdot cm^{-1}$ ultraviolet light (Fusion System D bulb) at 3 $m \cdot min^{-1}$ for a total of three times. The resulting coated abrasive was thermally cured for about 15 minutes at 100° C.

TABLE 2

| Example | No. of Cycles | Cumulative Cut (g) | Surface Finish Ra/Rtm |
|---|---|---|---|
| C1 | 500 | 0.727 | 11/72 |
| | 1000 | 1.266 | — |
| | 1500 | 1.692 | — |
| | 2000 | 2.015 | 6/39 |
| 3 | 500 | 0.733 | 17/112 |
| | 1000 | 1.330 | — |
| | 1500 | 1.841 | — |
| | 2000 | 2.264 | 11/71 |
| 4 | 500 | 0.911 | 21/137 |
| | 1000 | 1.614 | — |
| | 1500 | 2.313 | — |
| | 2000 | 2.841 | 11/80 |
| 5 | 500 | 0.881 | 12/78 |
| | 1000 | 1.632 | — |
| | 1500 | 2.282 | — |
| | 2000 | 2.854 | 8/50 |

— Surface finish was not measured for these cycles.

EXAMPLES 6-8 AND COMPARATIVE EXAMPLE 3

This set of Examples compared various coated abrasive constructions. The resulting coated abrasives were tested according to the Disc Test Procedure II and the results are summarized in Table 3.

EXAMPLE 6

A make coat precursor was prepared with FC 85 parts, 1 part PH4, 0.03 part PH3, 0.1 part HDODA and 15 parts of ethoxylated bisphenol A. Just prior to coating, the make coat precursor was heated in a water bath at 90° C. Next, 7.5 parts of PUP1 and 7.5 parts of IPDI were then thoroughly mixed into the make coat precursor. The resulting make coat precursor was degassed under vacuum in a desiccator to remove air bubbles and dissolved oxygen. The make coat precursor was then knife-coated to a thickness of 0.05 mm onto a D weight Kraft paper. Prior to coating, the knife-coater was heated with infrared lamps to a temperature between 70° to 90° C. for about 30 minutes. A release-coated polyester film cover sheet was placed over the make coat precursor during knife coating and subsequent processing. The make coat precursor was irradiated at 0.5 $m \cdot min^{-1}$ with two 120 Watt $\cdot cm^{-1}$ flood lights placed approximately 5 cm above the release film. Following this, the make coat precursor was irradiated with ultraviolet light for a total energy exposure of about 600 $milliJoules \cdot cm^{-2}$. The cover sheet was then removed and grade 400 aluminum oxide abrasive grain was drop coated into the make coat precursor. The abrasive grain layer had an average weight of about 45 $g \cdot m^{-2}$. The resulting product was thermally cured at 100° C. for 15 minutes. Subsequently, a size coat precursor was sprayed over the abrasive grains. The size coat precursor was a 90:10 ratio of RP1:PP with 1% WA. The size coat precursor was diluted to 20% solids with a 50:50 blend of ethanol and ethylene glycol monoethyl ether. The resulting product was precured for one hour at 88° C. and final cured for 90 minutes at 120° C.

EXAMPLE 7

A coated abrasive was prepared according to Example 6 except the ethoxylated bisphenol A was replaced with the hydroxyethylated bisphenol of methylethylketone. Further, the abrasive grain coating weight was about 39 $g \cdot m^{-2}$.

EXAMPLE 8

A coated abrasive was prepared according to Example 7 except the release liner was removed after the visible light irradiation (flood lights) and the abrasive grains were drop-coated into the make coat. The abrasive grain coating had an average weight of 43 $g \cdot m^{-2}$. The make coat precursor/abrasive grains were then irradiated with ultraviolet light.

COMPARATIVE EXAMPLE 3

Comparative Example 3 was a grade 400 Production Wetordry Paper Type T2 coated abrasive (commercially available from the 3M Company, St. Paul, Minn.). The backing for this coated abrasive was an A weight waterproof paper. The abrasive grain was fused aluminum oxide.

TABLE 3

| Example | No. of Cycles | Cumulative Cut (g) | Surface Finish Ra/Rtm |
|---|---|---|---|
| 6 | 500 | 1.113 | 13/82 |
| | 2000 | 3.346 | 12/68 |
| | 4000 | 5.029 | 11/64 |
| 7 | 500 | 1.154 | 14/82 |
| | 2000 | 3.260 | 11/70 |
| | 4000 | 5.501 | 11/68 |
| 8 | 500 | 1.130 | 16/104 |
| | 2000 | 3.600 | 13/82 |
| | 4000 | 6.292 | 12/72 |
| C3 | 500 | 0.737 | 10/66 |
| | 2000 | 1.856 | 12/64 |
| | 4000 | 2.538 | 9/49 |

EXAMPLES 9-14 AND COMPARATIVE EXAMPLE 4

This set of Examples compared various coated abrasive constructions. The resulting coated abrasives were tested according to the Disc Test Procedure III and the results are summarized in Table 4.

EXAMPLE 9

A make coat precursor was prepared with FB 60 parts, 20 parts of EM2, 20 parts of EM3, 4 parts of cyclohexanedimethanol, 1 part of PH1, 1 part of PH3 and 1 part of tBOX. The make coat precursor was degassed under vacuum in a desiccator to remove air bubbles and dissolved oxygen. Then, the make coat precursor was knife-coated to a thickness of 0.05 mm onto 0.13 mm thick polyester film previously primed with an ethylene acrylic acid copolymer. A release-coated polyester film cover sheet was placed over the make coat precursor during knife-coating and subsequent processing. The make coat precursor was then irradiated with 600 $mJ \cdot cm^{-2}$ of ultraviolet light. The cover sheet was then removed and grade P120 aluminum oxide abrasive grain was electrostatically coated into the make coat precursor. The abrasive grain layer had an average weight of 190 $g \cdot m^{-2}$. The resulting product was thermally cured at 100° C. for 15 minutes. Subsequently, a size coat precursor was sprayed over the abrasive grains. The size coat precursor was prepared using 48% RP2 and 52% calcium carbonate filler. The size coat precursor was diluted to 70% solids with a 90:10 water:2-ethoxy ethanol solvent. The size coat precursor coating weight was 110 $g \cdot m^{-2}$. The resulting product was precured for about 90 minutes at 90° C., final cured for 10 hours at 100° C. and post cured for about 30 minutes at 116° C. After this curing the coated abrasive was flexed.

EXAMPLE 10

A coated abrasive was prepared according to Example 9 except the size coat precursor coating weight was 170 $g \cdot m^{-2}$.

EXAMPLE 11

A coated abrasive was prepared according to Example 9 except the size coat precursor coating weight was 200 $g \cdot m^{-2}$.

EXAMPLE 12

A coated abrasive was prepared according to Example 9 except the make coat precursor was prepared using 60 parts of FB, 20 parts of EM2, 20 parts of EM3, 4 parts of 1,4-cyclohexane dimethanol, 1 part of PH1, 1 part of PH3, 0.08 parts of HDODA and 1 part of tBOX. The size coat precursor coating weight was 150 $g \cdot m^{-2}$.

EXAMPLE 13

A coated abrasive was prepared according to Example 9 except the make coat precursor was prepared using 60 part of FB, 20 parts of EM2, 20 parts of EM3, 4 parts of 1,4-cyclohexane dimethanol, 1 part of PH1, 1 part of PH3, 5 parts of glycidyl acrylate and 1 part of tBOX. The size coat precursor coating weight was 150 $g \cdot m^{-2}$.

COMPARATIVE EXAMPLE 4

Comparative Example 4 was a grade P120 Three-M-ite Resin Bond film closed coat coated abrasive (commercially available from the 3M Co., St. Paul, Minn.).

TABLE 4

| Example | No. of Cycles | Cumulative Cut (g) |
|---|---|---|
| 9 | 500 | 0.339 |
| | 1000 | 0.505 |
| | 1500 | 0.599 |
| | 2000 | 0.669 |
| | 2500 | 0.723 |
| 10 | 500 | 0.448 |
| | 1000 | 0.642 |
| | 1500 | 0.758 |
| | 2000 | 0.843 |
| | 2500 | 0.905 |
| 11 | 500 | 0.469 |
| | 1000 | 0.713 |
| | 1500 | 0.844 |
| | 2000 | 0.944 |
| | 2500 | 1.020 |
| 12 | 500 | 0.400 |
| | 1000 | 0.564 |
| | 1500 | 0.658 |
| | 2000 | 0.734 |
| | 2500 | 0.799 |
| 13 | 500 | 0.455 |
| | 1000 | 0.656 |

TABLE 4-continued

| Example | No. of Cycles | Cumulative Cut (g) |
|---|---|---|
| | 1500 | 0.744 |
| | 2000 | 0.860 |
| | 2500 | 0.931 |
| C4 | 500 | 0.510 |
| | 1000 | 0.751 |
| | 1500 | 0.894 |
| | 2000 | 0.977 |
| | 2500 | 1.049 |

EXAMPLES 14 AND 15

This set of examples compared the performance of coated abrasives in which polymerization of the make coat precursor was initiated before and after the abrasive grains were applied. The coated abrasives were tested under Test Procedure III and the results are summarized in Table 5.

EXAMPLE 14

A make coat precursor was prepared by thoroughly mixing the contents of FB 60 parts with 20 parts of EM2, 20 parts of EM3, 4 parts of 1,4-cyclohexane dimethanol, 0.5 part of PH1, 0.5 part of PH3 and 0.5 part of tBOX. The resulting make coat precursor was degassed under vacuum. The make coat precursor was knife-coated to a thickness of 0.05 mm onto a polyester film previously primed with an ethylene acrylic acid copolymer. The make coat precursor was irradiated under a nitrogen atmosphere by passing the coated film under two 80 $Watts \cdot cm^{-1}$ mercury lamps four times at 15 $m \cdot min^{-1}$. Grade 1000 JIS white aluminum oxide was drop coated into the make coat precursor. The abrasive grain layer had an average weight of 15 $g \cdot m^{-2}$. The resulting product was thermally cured at 110° C. for 15 minutes. The remaining steps to prepare the coated abrasive were the same as Example 6.

EXAMPLE 15

This is a comparative example using the backing, make coat, precursor and abrasive grains as used in Example 14. The make coat precursor was knife-coated onto the backing with a thickness of about 8 micrometers (μm). The abrasive grain weight was about 23 $g \cdot m^{-2}$. After the abrasive grains were applied, polymerization of the make coat precursor was initiated by exposing the resulting material under a nitrogen atmosphere to two 80 $Watts \cdot cm^{-1}$ mercury lamps four times at 15 $m \cdot min^{-1}$. The resulting product was thermally cured at 110° C. for 15 minutes. The remaining steps to prepare the coated abrasive were the same as Example 6. The abrasive grain coating was very blotchy.

TABLE 5

| Example | No. of Cycles | Cumulative Cut (g) |
|---|---|---|
| 14 | 500 | 0.41 |
| | 1000 | 0.77 |
| | 1500 | 1.13 |
| | 2000 | 1.37 |
| | 2500 | 1.63 |
| 15 | 500 | 0.31 |
| | 1000 | 0.53 |
| | 1500 | 0.75 |
| | 2000 | 0.89 |

TABLE 5-continued

| Example | No. of Cycles | Cumulative Cut (g) |
|---|---|---|
| | 2500 | 1.03 |

Examples 14 and 15, the surface finish (500 cycles) Ra/Rtm was 6/43 and 8/45, respectively.

EXAMPLES 16–21

This set of Examples compared various coated abrasive constructions. The resulting coated abrasives were tested according to the Disc Test Procedure II and Disc Test Procedure III and the results are summarized in Tables 6 and 7.

EXAMPLE 16

The coated abrasive for Example 16 was made in the same manner as Example 9 except that the make coat precursor thickness was 0.10 millimeters and the size coat precursor coating weight was 205 $g \cdot m^{-2}$.

EXAMPLE 17

The coated abrasive for Example 17 was made in the same manner as Example 9 except that the make coat precursor thickness was 0.20 millimeters and the size coat precursor coating weight was 197 $g \cdot m^{-2}$.

EXAMPLE 18

The coated abrasive for Example 18 was made in the same manner as Example 9 except that the make coat precursor thickness was 0.025 millimeters and the size coat precursor coating weight was 205 $g \cdot m^{-2}$. Additionally, the make coat precursor further contained 0.5 part of tBOX.

EXAMPLE 19

The coated abrasive for Example 19 was made in the same manner as Example 9 except that the make coat precursor further contained 0.5 part of tBOX and the size coat precursor coating weight was 205 $g \cdot m^{-2}$.

EXAMPLE 20

The coated abrasive for Example 20 was made in the same manner as Example 9 except that the make coat precursor thickness was 0.10 millimeters and the size coat precursor coating weight was 200 $g \cdot m^{-2}$. Additionally, the make coat precursor further contained 0.5 part of tBOX.

EXAMPLE 21

The coated abrasive for Example 21 was made in the same manner as Example 20 except that a different size coat precursor was employed. The size coat consisted of 50% by weight alumina trihydrate filler and 50% by weight of an epoxy resin formulation. The epoxy resin formulation was diluted with MEK solvent to 75% solids. The epoxy resin formulation consisted of 90 parts EM4, 10 parts HDODA, 0.25 part PH1 and 0.25 part PH4. After the size coat precursor was sprayed over the abrasive grains, the resulting coated abrasive article was exposed to four ultraviolet lamps operating at 150 $Watts \cdot cm^{-1}$ with a run speed of 4.5 $m \cdot min^{-1}$. The coated abrasive was then thermally cured for one hour at 100° C.

TABLE 6

| Example | No. of Cycles | Cumulative Cut (g) |
|---|---|---|
| 11 | 500 | 0.96 |
| | 1000 | 1.88 |
| | 1500 | 2.65 |
| | 2000 | 3.48 |
| | 2500 | 4.28 |
| 21 | 500 | 1.27 |
| | 1000 | 2.54 |
| | 1500 | 3.65 |
| | 2000 | 4.72 |
| | 2500 | 5.74 |
| C4 | 500 | 1.24 |
| | 1000 | 2.38 |
| | 1500 | 3.50 |
| | 2000 | 4.61 |
| | 2500 | 5.64 |

TABLE 7

| Example | No. of Cycles | Cumulative Cut (g) |
|---|---|---|
| 9 | 500 | 0.50 |
| | 1000 | 0.73 |
| | 1500 | 0.85 |
| | 2000 | 0.94 |
| | 2500 | 1.02 |
| 16 | 500 | 0.48 |
| | 1000 | 0.67 |
| | 1500 | 0.76 |
| | 2000 | 0.82 |
| | 2500 | 0.88 |
| 17 | 500 | 0.48 |
| | 1000 | 0.68 |
| | 1500 | 0.82 |
| | 2000 | 0.90 |
| | 2500 | 0.94 |
| 18 | 500 | 0.53 |
| | 1000 | 0.72 |
| | 1500 | 0.84 |
| | 2000 | 0.92 |
| | 2500 | 0.98 |
| 19 | 500 | 0.48 |
| | 1000 | 0.64 |
| | 1500 | 0.73 |
| | 2000 | 0.79 |
| | 2500 | 0.85 |
| 20 | 500 | 0.50 |
| | 1000 | 0.70 |
| | 1500 | 0.83 |
| | 2000 | 0.91 |
| | 2500 | 0.95 |
| C4 | 500 | 0.56 |
| | 1000 | 0.83 |
| | 1500 | 0.93 |
| | 2000 | 1.01 |
| | 2500 | 1.07 |

EXAMPLE 22-24 AND COMPARATIVE EXAMPLE 5

This set of Examples compared various coated abrasive constructions. The resulting coated abrasives were tested according to the Disc Test Procedure IV and Disc Test Procedure I and the results are summarized in Table 8.

EXAMPLE 22

This example describes a 600 grit abrasive construction with an epoxy-acrylate make coat which was polymerized with high intensity UV light at a high web rate in air. A make coat precursor was prepared by using a stock solution of EM2/EM3(80:20) made by mixing 480 parts EM2 and 120 parts EM3, heating in an oven at 80° C. and shaking until it was a homogeneous solution. To 160 parts of this solution, were added 20 parts TEGDA, 20 parts BDDA, 16.07 parts 1,4-cyclohexane dimethanol, 1.0 part PH3, 1.0 part tBOX, and 1.0 part PH1 (KB-1). This mixture was heated in an oven at 60° C. until homogeneous and then stored in the dark at room temperature until used. This solution was knife coated at 50 μm thickness onto 100 μm polyester film. It was exposed to high intensity UV light operating at 120 Watts·cm$^{-1}$ with a run speed of about 24 m·min$^{-1}$. Grade 600 silicon carbide abrasive grain was drop-coated into the make coat such that the film was completely covered with abrasive grains to substantially a mono-layer thickness. The resulting product was thermally cured at 100° C. for about 30 minutes. The size coat precursor was the same as described in Example 5. The coated abrasive article was then precured and cured according to the procedures of Example 5.

EXAMPLE 23

This example describes a 1200 grit abrasive construction with an epoxy-acrylate make coat which was polymerized with high intensity UV light at a high web rate in air. The make coat precursor was prepared using a stock solution of EM2/EM3 (50:50) made by mixing 250 parts EM2 and 250 parts EM3, heating in an oven at 80° C. and shaking until it was a homogeneous solution. To 75.33 parts of this solution were added 19.83 parts TEGDA, 5.84 parts 1,4-cyclohexanedimethanol, 1.0 part PH1, 1.0 part tBOX and 1.0 part PH3. This mixture was heated at 60° C. until all ingredients were in solution, then stored in the dark at room temperature until used. This solution was knife coated at 50 μm thickness onto 100 μm polyester film. It was exposed to high intensity UV light operating at 80 Watts·cm$^{-1}$ with a run speed of about 15 m·min$^{-1}$. Grade 1200 silicon carbide abrasive grain was drop-coated onto the make coat, such that the film was completely covered with abrasive grains to substantially a mono-layer thickness. The resulting product was thermally cured at 100° C. for about 30 minutes. The size coat precursor was the same as described in Example 5. The coated abrasive article was then precured and cured according to the procedures of Example 5.

EXAMPLE 24

A make coat precursor was prepared by thoroughly mixing 60 parts EM2, 32 parts IOA, 8 parts HDODA, 0.4 part PH3, 0.4 part tBOX, 2 part PH1. The make coat precursor was roll-coated onto an A weight waterproof paper at a coating weight of 4 g·m$^{-1}$. The make coat precursor was then irradiated with 600 milliJoules·cm$^{-2}$ of ultraviolet light in air. Grade 1220 silicon carbide abrasive grain was then coated electrostatically into the make coat precursor. The abrasive grain layer had an average weight of 14.5 g·m$^{-2}$. The resulting product was thermally cured at 115° C. for 10 minutes. The size coat precursor was identical to Example 5 except it was diluted to 90% solids with toluene. It was roll-coated onto the abrasive product to a coating weight of 8 g·m$^{-2}$. Subsequently, it was irradiated at 10 m·min$^{-1}$ with a 120 Watt/cm ultraviolet lamp. The resulting coated abrasive was thermally cured for 60 minutes at 115° C.

COMPARATIVE EXAMPLE 5

Comparative Example 5 was a grade 1200 Tri-M-ite Wetordry Type W coated abrasive (commercially available from the 3M Co., St. Paul, Minn.).

TABLE 8

| Example | No. of Cycles | Cumulative Cut (g) |
|---|---|---|
| 22 | 500 | 0.994 |
| (IV) | 1000 | 1.865 |
| | 1500 | 2.627 |
| | 2000 | 3.366 |
| | 2500 | 4.050 |
| C1 | 500 | 0.590 |
| (IV) | 1000 | 0.981 |
| | 1500 | 1.274 |
| | 2000 | 1.518 |
| | 2500 | 1.916 |
| 23 | 500 | 0.574 |
| (IV) | 1000 | 1.039 |
| | 1500 | 1.509 |
| | 2000 | 1.870 |
| | 2500 | 2.220 |
| C5 | 500 | 0.199 |
| (IV) | 1000 | 0.280 |
| | 1500 | 0.280 |
| | 2000 | 0.319 |
| | 2500 | 0.370 |
| 24 | 500 | 0.713 |
| (I) | 1000 | 1.153 |
| | 1500 | 1.618 |
| | 2000 | 2.042 |
| | 2500 | 2.380 |
| C5 | 500 | 0.379 |
| (I) | 1000 | 0.617 |
| | 1500 | 0.829 |
| | 2000 | 0.920 |
| | 2500 | 1.021 |

Various modifications and alterations of this invention will become apparent to those skilled in the art without departing from the scope and spirit of this invention, and it should be understood that this invention is not to be unduly limited to the illustrative embodiments set forth herein.

We claim:

1. A method for making a coated abrasive article comprising the steps:

(1) applying a make coat precursor to a backing, wherein the make coat precursor comprises:

(a) at least one ethylenically unsaturated monomer, and (b) at least one of a cationically polymerizable monomer initiator or a polyurethane precursor, and (c) a catalytically-effective amount of a curing agent comprising:

(i) at least one cationically polymerizable monomer or polyurethane precursor initiator, (ii) optionally, at least one thermally decomposable ester reaction product of a tertiary alkyl alcohol and an acid that forms a chelation complex with a metal ion of an organometallic complex salt, provided component (b) is a cationically polymerizable monomer, and (iii) optionally, at least one free radical initiator;

(2) exposing the make coat precursor to an energy source to activate a organometallic complex salt;

(3) partially polymerizing, either sequentially or simultaneously, the cationically polymerizable monomer or the polyurethane precursor; the ethylenically, unsaturated monomer; or both;

(4) applying a plurality of abrasive grains onto the make coat precursor;

(5) applying a size coat precursor;

(6) fully curing the make coat precursor; and (7) fully curing the size coat precursor.

2. The method according to claim 1 wherein the cationically polymerizable monomer of the make coat precursor is partially cured prior to applying the plurality of abrasive grains and then the make coat precursor is fully cured.

3. The method according to claim 2 wherein the size coat precursor is applied before the make coat precursor is fully cured.

4. The method according to claim 2 wherein the size coat precursor is applied after the make coat precursor is fully cured.

5. The method according to claim 1 wherein the ethylenically unsaturated monomer of the make coat precursor is partially cured prior to applying the plurality of abrasive grains and then the make coat precursor is fully cured.

6. The method according to claim 5 wherein the size coat precursor is applied before the make coat precursor is fully cured.

7. The method according to claim 5 wherein the size coat precursor is applied after the make coat precursor is fully cured.

8. The method according to claim 1 wherein the plurality of abrasive grains is substantially a monolayer.

9. A method for making a coated abrasive article comprising:

(1) applying a make coat precursor to a backing, wherein the make coat precursor comprises a pressure sensitive adhesive precursor;
(2) fully curing the make coat precursor to a pressure sensitive adhesive;
(3) applying a plurality of abrasive grains into the cured make coat;
(4) applying a size coat precursor; and
(5) fully curing the size coat precursor.

10. A method for making a coated abrasive article comprising:

(1) applying a make coat precursor to a backing, wherein the make coat precursor comprises:
(a) at least one ethylenically unsaturated monomer, and
(b) at least one of a cationically polymerizable monomer or a polyurethane precursor, and
(c) a catalytically-effective amount of a curing agent comprising:
(i) at least cationically polymerizable monomer initiator or polyurethane precursor initiator,
(ii) optionally, at least one thermally decomposable ester reaction product of a tertiary alkyl alcohol and an acid that forms a chelation complex with a metal ion of an organometallic complex salt, provided component (b) is a cationically polymerizable monomer, and
(iii) optionally, at least one free radical initiator;
(2) exposing make coat precursor to an energy source to activate either sequentially or simultaneously, the cationically polymerizable monomer or the polyurethane precursor; the ethylenically, unsaturated monomer; or both;
(3) fully curing the make coat precursor;
(4) applying a plurality of abrasive grains onto the make coat precursor;
(5) applying a size coat precursor; and
(6) fully curing the size coat precursor.

11. The method according to claim 10 wherein the ethylenically unsaturated monomer is selected from the group consisting of (meth)acrylates, (meth)acrylamide, and vinyl compounds.

12. The method according to claim 10 wherein the cationically polymerizable monomer undergoes cationic polymerization and includes 1,2-, 1,3-, and 1,4-cyclic ethers, and vinyl ethers.

13. The method according to claim 10 wherein the polyurethane precursor is a mixture of one or more monomers including polyisocyanates and one or more polyol, or monomers bearing at least two isocyanate-reactive hydrogen atoms and such that the ratio of isocyanate groups to isocyanate-reactive hydrogens atoms is 1:2 to 2:1.

14. The method according to claim 10 wherein the plurality of abrasive grains is substantially a monolayer.

* * * * *